US006971314B2

(12) United States Patent
Maguire

(10) Patent No.: US 6,971,314 B2
(45) Date of Patent: Dec. 6, 2005

(54) MUNITIONS MINES

(75) Inventor: Brian Maguire, 13615 NW. Pettygrove St., Portland, OR (US) 97229

(73) Assignee: Brian Maguire, Portland, OR (US)

( * ) Notice: Subject to any disclaimer, the term of this patent is extended or adjusted under 35 U.S.C. 154(b) by 183 days.

(21) Appl. No.: 10/624,790

(22) Filed: Jul. 21, 2003

(65) Prior Publication Data

US 2005/0016410 A1 Jan. 27, 2005

(51) Int. Cl.[7] ..... F42B 12/00; B64D 1/04

(52) U.S. Cl. ..... 102/430; 102/431; 102/401; 102/402; 102/403; 89/1.19; 89/1.11; 42/106

(58) Field of Search ..... 102/401–403, 102/431, 426, 470, 700

(56) References Cited

U.S. PATENT DOCUMENTS

| | | | | |
|---|---|---|---|---|
| 2,562,928 A | | 8/1951 | Lewis | |
| 3,427,975 A | * | 2/1969 | Wessells et al. | 102/334 |
| 3,667,387 A | * | 6/1972 | Picard et al. | 102/426 |
| 3,670,649 A | * | 6/1972 | Hartlein et al. | 102/431 |
| 4,221,167 A | * | 9/1980 | Berlin et al. | 102/334 |
| 4,389,940 A | | 6/1983 | Trembly et al. | |
| 4,759,885 A | | 7/1988 | Kurtz | |
| 4,926,752 A | | 5/1990 | DiRubbio et al. | |
| 5,016,537 A | | 5/1991 | Pinson | |
| 5,196,649 A | | 3/1993 | DiRubbio et al. | |
| 5,237,927 A | * | 8/1993 | Gonzalez et al. | 102/431 |
| 5,329,855 A | | 7/1994 | Szyndlar | |
| 5,402,729 A | | 4/1995 | Richert | |
| 5,726,378 A | * | 3/1998 | Barrett | 102/431 |
| 5,824,939 A | | 10/1998 | Handelman | |
| 5,841,063 A | | 11/1998 | Hellkvist et al. | |
| 5,936,184 A | * | 8/1999 | Majerus et al. | 102/403 |
| 5,996,265 A | * | 12/1999 | Coury | |
| 6,148,557 A | * | 11/2000 | Lindskog et al. | 42/70.01 |
| 6,202,560 B1 | | 3/2001 | Guirguis | |
| 6,523,478 B1 | | 2/2003 | Gonzalez et al. | |
| 6,615,528 B1 | * | 9/2003 | Lindskog et al. | 42/70.01 |

* cited by examiner

*Primary Examiner*—Michael J. Carone
*Assistant Examiner*—Lulit Semunegus

(57) ABSTRACT

Mines are fabricated in the form of munitions, specifically including cartridges for firearms and several types of grenade, including both hand grenades and rocket-propelled grenades, the cartridges containing either very high energy explosives or very high temperature burning materials, that upon ignition will at least destroy the firearm in which fired or may exert lethal force against the user, while such mines in the form of grenades will explode immediately upon being activated rather than exhibit the expected time delay, both types of mines being supplied surreptitiously to an enemy force for its unknowing use, thereby to direct the lethal effect of such munitions against those enemy forces rather than the friendly forces as the enemy forces would have intended.

8 Claims, 4 Drawing Sheets

Fig. 1.
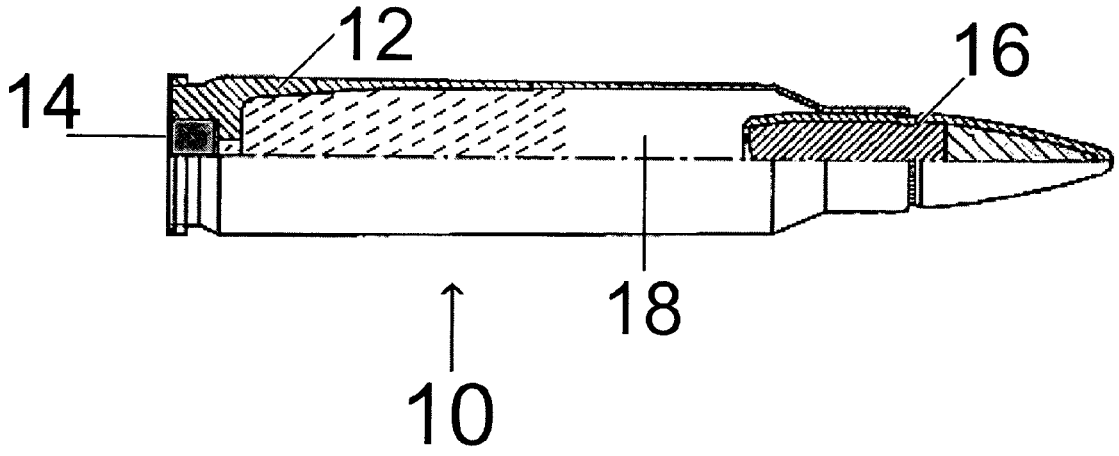
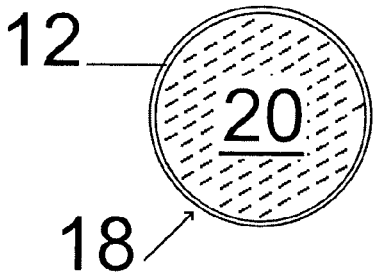
Fig. 2.

PRIOR ART

MUNITIONS MINES

CROSS-REFERENCE TO RELATED APPLICATIONS

None

STATEMENT REGARDING FEDERALLY SPONSORED RESEARCH OR DEVELOPMENT

Not applicable

BACKGROUND OF THE INVENTION

1. Field of the Invention

This invention relates to mines that are implemented in the form of enemy munitions, particularly to small arms cartridges, grenades and similar munitions that have been specially fabricated to explode or burn with sufficient force or heat to destroy the firearm in which fired, either by using excessively powered types of explosive or burning material or by the deletion of safety means.

2. Background Information

It is a fundamental principle of ammunition design and fabrication that the products manufactured are to be capable of being fired safely, with no danger to the user and minimal damage to the firearm in which fired. In warfare, on the other hand, the object will often be that of making the environment of a user of ordnance, including small arms ammunition, as fraught with danger as possible. However, in today's world of armed conflict, enemies are becoming indistinct from the civilian population, both around the world and in the United States. That circumstance renders many traditional military strategies either too dangerous to be used, or impractical because of the need to avoid civilian casualties. For example, it is deemed to be unacceptable, and indeed immoral, to use mines in the old, traditional ways of human culture, due to the obvious danger to civilians. Yet as enemies become less distinct from innocent civilians in such ways as appearance, and their movements, in other ways these enemies are becoming more distinct.

Specifically, during the rise of the Soviet Union, the Kalishnikov rifle, popularly known as the AK47, became the weapon of choice for much of the world. The AK47, which is quite cheaply made, is manufactured in many countries and can be purchased in the United States for little more than $150. In many ways, the AK47 is superior to the U.S.-made M4A1 (M 16), however, it does have one feature that can be exploited, namely, that the ammunition for the AK47 is very distinct from the ammunition used by the United States and its allies. That is, the ammunition for these weapons is different from that used by the U.S. and its allies. The dissimilarity between the weapons employed by non-NATO countries extends to a wide range of arms including hand grenades, rocket propelled grenades, automatic rifles and side arms.

The distinguishing feature of the AK47 as to the ammunition it uses is shown by the present invention to be relevant also to the use of mines. That is, it has long been standard military practice in many tactical situations to interdict movement of enemy personnel by dispersing antipersonnel mines in a particular area. For such purpose, it is very important that such mines must:

(a) be adapted for dispersal by various means, e.g., as by dispersal by personnel, by ordnance as from military shells, rockets or bombs;

(b) be safe to handle before dispersal, even after an extended period in storage under adverse environmental conditions;

(c) be effective for a predetermined length of time after dispersal;

(d) be inexpensive to manufacture;

(e) be effective in concealment; and (f) be noninvasive to civilians.

Unfortunately, there is no known type of antipersonnel mine that meets all of the listed criteria.

The nature, use and creation of antipersonnel mines in the traditional manner, as is embodied in land mines, either antitank or antipersonnel, is well known in the prior art. That art also describes means to make ammunition safer, either by using a cellulose base propellant or by other means as shown, for example, in U.S. Pat. No. 5,841,063 issued Nov. 24, 1998, to Hellkvist et al., which provides a longitudinal weakening along the cartridge case that will remain intact when the cartridge is fired within the chamber of a weapon in the normal manner, but will break if the cartridge is subjected to heat while outside of a firearm, thereby allowing the charge perhaps to burn, but preventing its explosion.

The art of dispersing mines that are to explode shortly after dispersal by ordnance is also known, and is shown, for example, in U.S. Pat. No. 4,389,940 issued Jun. 28, 1983 to Trembly et al. This patent describes ordnance being loaded with a number of antipersonnel mines, the timed explosion of which is controlled by a method of capacitive discharge. However, the combination of ordnance and the dispersal of mines that are to explode upon activation by external means in the manner described herein has not been addressed in the prior art. Applicant is unaware of any system or device that can be used surreptitiously to cause enemy forces unwittingly to destroy their weapons or kill themselves, although such a device would be a legitimate tool of war.

It has also been noted, for example in U.S. Pat. Nos. 4,926,752 and 5,196,649, issued to DiRubbio et al. on May 22, 1990, and Mar. 23, 1993, respectively, that in hand grenades one must include a delay charge in order to prevent instantaneous functioning of the grenade, or too quick functioning if there were insufficient delay charge. It was not suggested, however, that such delay charge might be omitted intentionally, thereby to bring about such instantaneous or rapid functioning for the express purpose of destroying the grenade and perhaps killing the user.

It would be useful, therefore, to provide means for the destruction of such weapons in the hands of the enemy, especially small arms, grenades, and RPGs. As a part of that, it would be desirable as well to bring about the killing of the enemy. For wartime purposes, it would be desired that a person unknowingly fire such a cartridge, or use a hand grenade or rocket propelled grenade or the like, thereby to destroy the weapon and at the same time kill the enemy military personnel that had sought to use the weapon.

Occasions can also arise as to illegal weapons or the like when it is desired to destroy weapons outside of a war setting. Such weapons may have come into possession of the legal authorities via a number of ways, for example, by way of confiscation in the arrest of both ordinary criminals and terrorists. Such destruction is often done by burning, but the destruction by that means cannot be fully assured, especially considering the heavy metal components involved. It would also be useful, therefore, to have more assured means for the destruction of weapons in that context.

Other prior art is described in an Information Disclosure Statement filed herewith.

SUMMARY OF THE INVENTION

In the present invention, the antipersonnel mine appears in the form of a "munitions mine," i.e., as what seems to be an ordinary firearm cartridge or grenade or the like, but instead, when that cartridge is fired, it will explode much more violently than would a normal cartridge, thereby to destroy, or at least severely damage, the firearm in which it was fired. The grenade, since it is already designed to explode with violence, accords with the purpose of the present invention by exploding at or very near the time of arming, i.e., while still in proximity to the user, and thereby to maim or perhaps kill that person. The invention is intended principally to be used unknowingly by enemy personnel, whether military forces or terrorists, and thereby to be killed. The same device can also be used knowingly, by a country's own law enforcement personnel, for purposes of the deliberate destruction of firearms that have been seized from criminals or terrorists and the like.

An ammunition round in the form of a cartridge is fabricated using as an explosive charge an excessively powerful material such as C4, that upon firing will destroy the firearm in which it has been fired, whereby the intent to render that firearm inoperable will be achieved. The charge so employed can instead be a highly reactive and super high temperature burning chemical such as white phosphorus. The cartridge is prepared in such a way as to be visibly indistinguishable from ordinary service cartridges of the same type, so that the user, unless otherwise informed, will not be aware that the cartridge will respond to firing in such fashion as to destroy the weapon and likely kill or at least incapacitate that user. As to grenades, these are supplied in the invention with an explosive fuse that does not set the timing by which the device will explode after having been thrown or projected by a rocket, but rather to explode as soon as armed, and thereby to kill the user. In an alternative embodiment, a type of grenade that would ordinarily include a delay charge has that charge removed, so again the grenade explodes in the hands of the user.

Surreptitious provision of such cartridges or grenades to the store of an enemy can result in the killing of enemy personnel who fire such a cartridge or use such grenades either in actual warfare or in training practice. Additionally, the ammunition supply that the enemy may have in store will be rendered unuseable since the enemy dare not use that store, having no way of knowing which additional cartridges or grenades, if any, have also been made to contain that same powerful charge or have had the timing of the grenade explosion altered. In both cases, the invention serves as an antipersonnel mine, but one that if properly handled is of no danger to civilians, being specifically targeted to the working domain of enemy personnel. Intentional destruction of firearms can also be carried out, by placing the firearm within a protective barrier and operating the trigger mechanism by remotely controlled means.

BRIEF DESCRIPTION OF THE SEVERAL VIEWS OF THE DRAWINGS

A preferred embodiment of the invention will now be described in detail with reference to the accompanying drawings, in which:

FIG. 1 is a view of a preferred embodiment of the invention in the form of an exemplary 0.308 cartridge 10, partially (approx. ¼) cut away along its longitudinal direction.

FIG. 2 shows the cartridge shown in FIG. 1 in transverse section through a powder chamber.

DETAILED DESCRIPTION OF THE INVENTION

Figure 3:
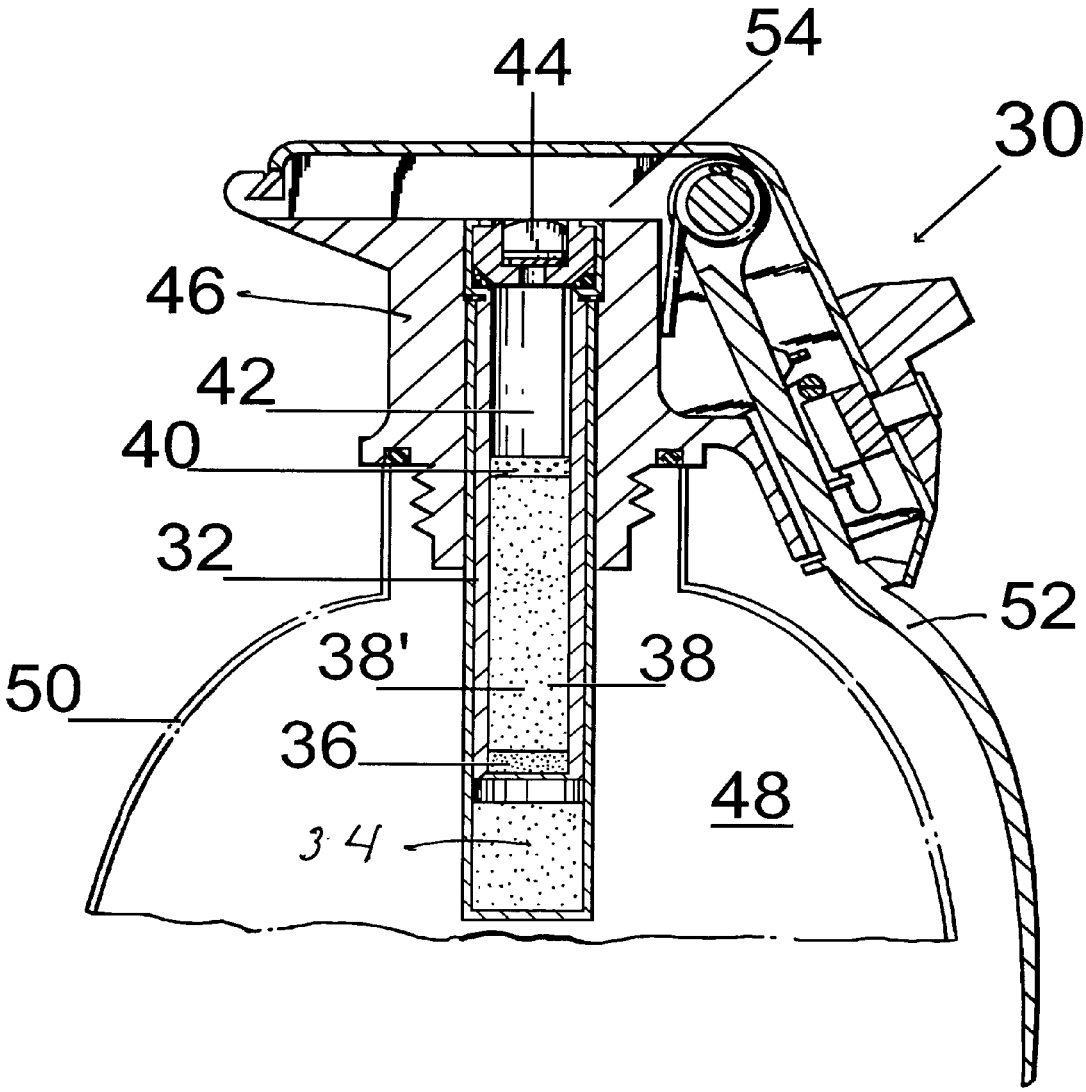
FIG. 3 shows in vertical half-section the top portion of a hand grenade in which the invention has been implemented.

It should be noted that in the drawings of the invention as implemented as a cartridge, nothing will be seen that would distinguish such cartridges from the prior art, and as to the grenade only one aspect thereof is subject to illustration, that aspect being a change in the number of types of charge placed within the grenade. However, that is of course a principal object of the invention, i. e., it is intended that both visually or by any other noninvasive means such as weight or the sound produced when tapped with a hard object, instances of the invention will indeed be indistinguishable from cartridges or grenades of the prior art, and specifically from cartridges or grenades in the stores of the enemy. These drawings are provided even so in order to show how instances of the invention are fabricated, and are then distinguishable from corresponding devices of the prior art only in the nature of the materials installed therein, or in one aspect of the invention pertaining to grenades, the deletion of one component charge.

FIG. 1 shows in longitudinal section along a central axis an exemplary 0.308 cartridge as a preferred embodiment of the invention. In external appearance this cartridge, as intended, is indistinguishable from a normal round. Of course, the inventive aspect of the cartridge of FIG. 1 can be applied to any kind of ammunition that has the basic structure shown therein, even conceivably, but perhaps impractically, to large ordnance shells. Unlike the normal usage of mines that are intended to destroy vehicles such as trucks or APCs (armored personnel carriers), the present invention is intended to destroy the arms that the enemy uses, as a means of killing the enemy forces themselves, i.e., to destroy those implements of war that do the actual damage to friendly forces when employed by the enemy.

In a tactical environment, when running low on ammunition as will sometimes occur, both enemy forces and our own have the practice of picking up free rounds of ammunition that are found laying on the ground that they would hope to be able to use. The method of use of the invention in that context is to "salt" the battlefield area with cartridge clips of the caliber and type used by the enemy, but of no use to friendly forces, an example being the type that is fired in the AK47, so as to make those "doctored" cartridges available to the enemy. By the time that the ruse is realized, a number of the enemy will unwittingly have killed themselves and destroyed their weapons, if they pick up any of the clips having cartridges according to the invention therein and that have been so placed, and then attempt to fire them.

It is evident that the same procedure can be applied by any person of ordinary skill in the art to other types of munitions, including hand grenades, rocket-propelled grenades (RPGs), pistol or revolver cartridges and the like, and any such usage would be equivalent to that described herein. The method of use as to grenades would be rather more difficult, since it would likely pertain only to the field of battle and not to domestic operations, perhaps requiring Delta Special Forces, Central Intelligence Agency (CIA), or other such undercover or "Black" operatives to have infiltrated into the "enemy camp," so to speak, and "salted" the enemy's ammunition stores with grenades that had been fabricated according to the present invention, if these friendly forces had with them a supply of such "doctored" grenades. Alternatively, if these friendly forces had encountered an enemy ammunition dump, the forces at hand could salt that dump and then carry out a "strategic withdrawal" (simulated retreat) in hopes that the enemy forces would return to make use of those stored munitions.

The charge used in the invention, perhaps C4 or white phosphorus, or any other type of explosive or chemical that is of sufficient power and can be safely handled, would be stable in the ordinary handling required to replace the enemy's ammunition with that according to the invention, or to add a quantity of such ammunition to the enemy store, so again this ruse would not likely be discovered until after an enemy had attempted to fire the particular munition. Even if the enemy was already carrying sufficient ammunition without resorting to those stores, it might not fully understand what had transpired and might fear even to use the ammunition that it was already carrying, but at least upon having several of its firearms blow up in the face of the user, as to any use of the stored ammunition it would fear to use any of that ammunition at all, and would thus be rendered impotent as a battlefield force without a shot from the friendly forces having been fired. Upon a consequent retreat by the enemy, the friendly forces could then just blow up that ammunition dump and eliminate any future danger from the doctored munitions.

For purposes of more fully explaining the nature of the invention, further description will now be given with reference to the above-listed drawings. FIG. 1 shows as a preferred embodiment of the invention an ammunition cartridge 10, partially (approx. ¼) cut away along its longitudinal direction. The cartridge of FIG. 1 has dimensions that correspond to those of a 0.308 cartridge or "shell," but the type of shell used for purposes of the invention could be of a shorter, stubbier type such as 0.45 caliber pistol ammunition, or indeed cartridges for virtually any kind of small arms weapon.

The standard components of such cartridges include the "shell casing" or "cartridge case" 12, a detonator 14 at the base or ignition end, as will be termed herein the proximal end of the cartridge, and a bullet 16 at the distal end of the cartridge. Between detonator 14 and bullet 16, shell casing 12 contains a powder chamber 18, within which there is ordinarily placed a quantity of gun powder. As is well known, when such a cartridge is fired, a firing pin (not shown) is caused by a trigger mechanism (not shown) to impinge along nearly a central, longitudinal axis of cartridge 10 in a sharp blow to the proximal end of cartridge 10, i.e., upon detonator 14, which by the energy of that impulse ignites a quantity of primer material within detonator 14, and that ignition in turn causes the ignition of the material in powder chamber 18. The principal aspect of the invention lies in the nature of the material that is placed within powder chamber 18. FIG. 2 then shows powder chamber 18 in cross-section through the relevant area of the powder chamber.

In either the initial manufacture or a retrofitting of a cartridge or the like that would be an instance of the invention, instead of ordinary gunpowder that is usually of the smokeless variety but which could be black powder in the case of hobbiest "reloaders" and the like, there is placed within powder chamber 18 a charge 20 constituting a quantity of explosive of a much higher energy content than that of the usual types of gunpowder just mentioned, or instead of a high energy explosive there could be used a highly exothermic (heat-releasing), high temperature-burning material. The explosive material could be C4 or the equivalent, and for the highly exothermic material there could be used a chemical such as white phosphorus (P). (Of course, there would not likely be any occasion to manufacture or retrofit hobbiest ammunition as used by black powder enthusiasts in the fashion described herein, but that type is mentioned nevertheless since black powder may be used instead of a detonating charge in grenades when an igniting fuze rather than a detonating fuse is used, as is mentioned in the Lewis patent noted below.)

Further explanation of the invention can be based on a description of its method of manufacture, or of the modification of existing, "live" ammunition, by which is meant cartridges that have been fully loaded with gunpowder and are ready to fire but are instead to be modified so as to produce an instance of the invention. The process of modifying an existing cartridge is treated first, and is in essence the same process as is used by hobby black powder aficiondos. The steps in this process are as follows:

1. Mark the position of bullet 16 in shell casing 12. This has the purpose of ensuring that a volume of charge 20 will be placed within the powder chamber 18 that matches the volume of gunpowder that had previously been present, and the distance to the tip or terminal end of bullet 18 will be same as before, thus giving the modified cartridge the same dimensions and appearance as those of the unmodified cartridge.
2. Extract bullet 16 from shell casing 12.
3. Remove existing powder.
4. If necessary, resize the cartridge, which may have been subjected to some abuse or been "recycled" from earlier firings.
5. If needed, depending on the explosive charge to be used, charge powder chamber 18 with a booster primer material such as mercury fulminate.
6. Charge the case with explosive material, i.e., charge 20, such as Cubane, C4, or other high explosive.
7. Seat bullet 16.
8. Crimp bullet 16.

In lieu of the explosive material, for charge 20 one may instead employ white phosphorus or a similar highly exothermic burning chemical. Use of an explosive will have the greater likelihood of shattering the firearm into shrapnel and thereby killing or seriously wounding the user, while the chemical is more likely just to expel the bullet and melt down the interior of the firearm, with less likelihood of wounding or killing the user.

In addition to the components themselves, assembling a cartridge that would embody the invention starting out with the bare components requires a small collection of tools, which are a soft cloth, a "lube pad" and lubricant, a sizer die, a press, and scales for weighing out the charge. The steps are then as follows:

1. Using a soft cloth, wipe each case clean to prevent dirt from scratching the case and resizing die. Inspect the case for anything that would prevent it from being safely reloaded, such as split case mouths, case head separations, excessive bulges and other case defects. Any case found to be defective should be crushed with a pair of pliers or in a vise and throw away that case.

2. Because of the forces involve, it will be necessary to lubricate the cases before they go into a sizer die. Spread some lubricant on the pad and lubricate the body of the case. If a carbide sizer for reloading straight-wall pistol cases is being used, this step may be eliminated, since the carbide ring of that kind of sizer is so smooth that cases cannot get stuck in it.
3. Clean dirt and powder residue from inside case necks and simultaneously add a light coating of "case lube" with a case neck brush. This lubricant will reduce the resizing effort and prevent excess working of the brass. Roll the brush across the lube pad after every three or four cases so as to have just the right amount of lubricant on the brush.
4. Expand the case mouth, which is a separate step required for reloading straight-wall cases. Because of their design, straight-wall cases need to be expanded in a separate expander die. Install the expander die in the press, place a sized case in the shell holder and run it into the die. The expander plug should be adjusted so the case mouth is belled or flared just enough to accept the new bullet.
5. Place a fresh primer, anvil side up, into the cup of the primer arm and insert a case into the shell holder.
6. Lower the handle and push the primer arm all the way into the slot in the shell holder ram.
7. Gently but firmly lower the press handle. As the case is drawn out of the die it will be lowered onto the fresh primer which will be seated into the primer pocket. Inspect the primer to make sure that it is properly seated. In order to gain optimum primer sensitivity, the primer must be seated firmly to the bottom of the primer pocket.
8. Charge the cases with the selected explosive or high-temperature burning material, such as Cubane, C4, some other high explosive material, or a high temperature material such as white phosphorus. This requires weighing out the proper amount of material.
9. Then take the weighed material and place it in the cartridge.
10. To seat the bullet, thread the seater die a few turns into the press. Put a case as had been prepared in the previous steps in the shell holder and lower the press handle, running the ram with the case to the top of the press stroke. Turn the die body down until it stops. The crimp shoulder in the die is now pressing against the top of the case mouth. Now, while looking at the head stamp on top of the die, back the die out one complete turn. This raises the crimp shoulder above the case mouth. Secure the die in position with the die lock ring.
11. Unscrew the seater plug enough to keep the bullet from being seated too deep.
12. With the handle in the "up" position, insert a properly primed and charged case into the shell holder.
13. Take a bullet and hold it over the case mouth with one hand while you lower the press handle with the other, easing the case and bullet up into the die. After raising the handle, note the seating depth of the loaded round.
14. If the bullet needs to be seated deeper into the case, run the seater plug down. Run the loaded round back up into the die, raise the press handle and check the seating depth again. It may take another adjustment or two to get the proper and final bullet seating depth. Once proper seating depth is achieved, tighten the small seater plug lock ring. (More detail on bullet seating and crimping is presented in the instructions set out above for the reloading case.)
15. Crimp the case.

The fabrication of a hand grenade or RPG is much simpler than the fabrication of a cartridge, since there is no need in the former case for a careful fit between a bullet and a cartridge case, although for safety reasons the fabrication must be done much more carefully. FIG. 3 shows in cross section the top portion of a generalized hand grenade, the detailed mechanical structure of which has no significance with respect to the present invention. In other words, as with the cartridge, the present invention makes no changes to the mechanical structure of any type of grenade, but only makes changes in the materials placed within that mechanical structure, either as to the nature of the material installed at a particular point in the normal sequence, for which a substitution of material is made, or by deletion of one or more of the materials.

As to the former type of change, FIG. 3 shows a hand grenade 30 into which is placed a triggering device 32 that thereby closes off the explosive material within the interior of the grenade body, and is made up, in sequence (commencing with the first-loaded material), of firstly a blasting cap 34, secondly a penetration charge 36, thirdly a fuse material 38, fourthly a fuse ignition charge 40, fifthly there is allowed an air gap 42, and sixthly there is a primer 44. Triggering device 32 is included within a grenade cap 46, which is itself structured so that a distal portion of triggering device 32 extends into a quantity of grenade explosive 48 that is held within first grenade body 50. Hand grenade 30 is seen further to have the well known structure of a handle 52 and a firing lever 54, as will be well known to a person of ordinary skill in the art and need not be described any further.

The invention is found in the replacement of fusing material 38 with an explosive material 38', which may be mercury fulminate or any similar explosive, that would be ignited by fuse ignition charge 40 and release sufficient energy upon being ignited to ignite immediately the penetration charge 36 and then blasting cap 34, thereby to ignite grenade explosive 48 that will break grenade body 50 into a quantity of shrapnel fragments for the intended lethal effect. Again, the purpose is to prevent the grenade from exploding in the vicinity of friendly forces, as would be intended by the enemy, but instead, if sought to be used by the enemy, to explode with lethal effect while still in the hands of those enemy forces, who would otherwise have sought to throw, or propel by rocket, the grenade at those friendly forces.

Figure 4:
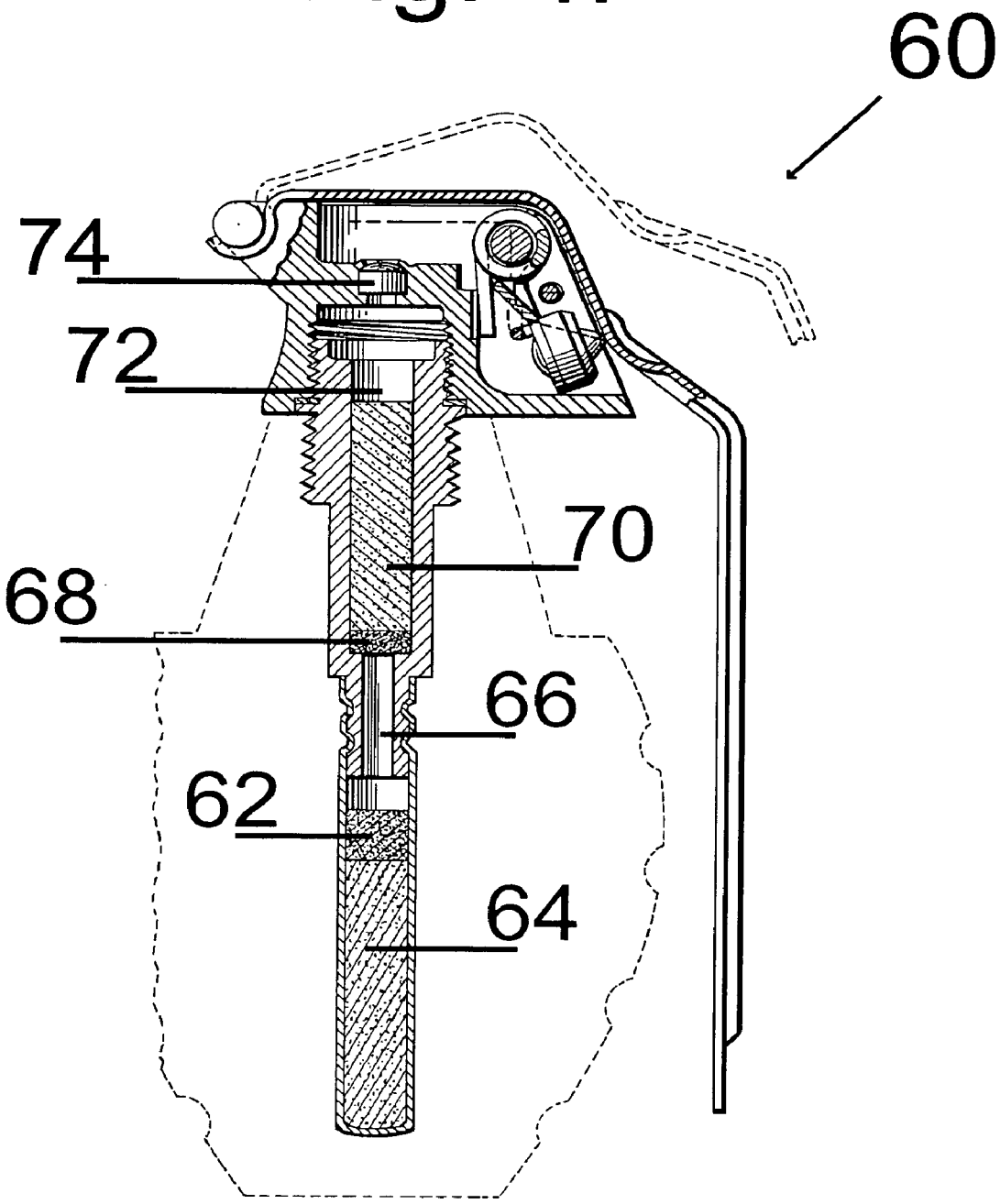
FIG. 4 shows in vertical half-section a type of hand grenade from the prior art that includes a delay charge.

A variation on the aforesaid embodiment of the invention derives from another type of grenade from the prior art, namely, that referred to by DiRubbio et al. in the '752 and '649 patents and disclosed in U.S. Pat. No. 2,562,928 issued on Aug. 7, 1951, to Lewis, that includes a delay charge. FIG. 4 shows the Lewis grenade 60 (U.S. Army Model M 213) of that '928 patent as containing, in sequence (commencing with the first-loaded material) along a triggering device 62 firstly a detonating charge 64, secondly a flash passageway 66, thirdly a relay charge 68, fourthly a delay charge 70, fifthly an air gap 72, and sixthly a percussion primer 74. The normal operation of the Lewis grenade is described in the Lewis patent '928 and need not be further explained here.

Figure 5:
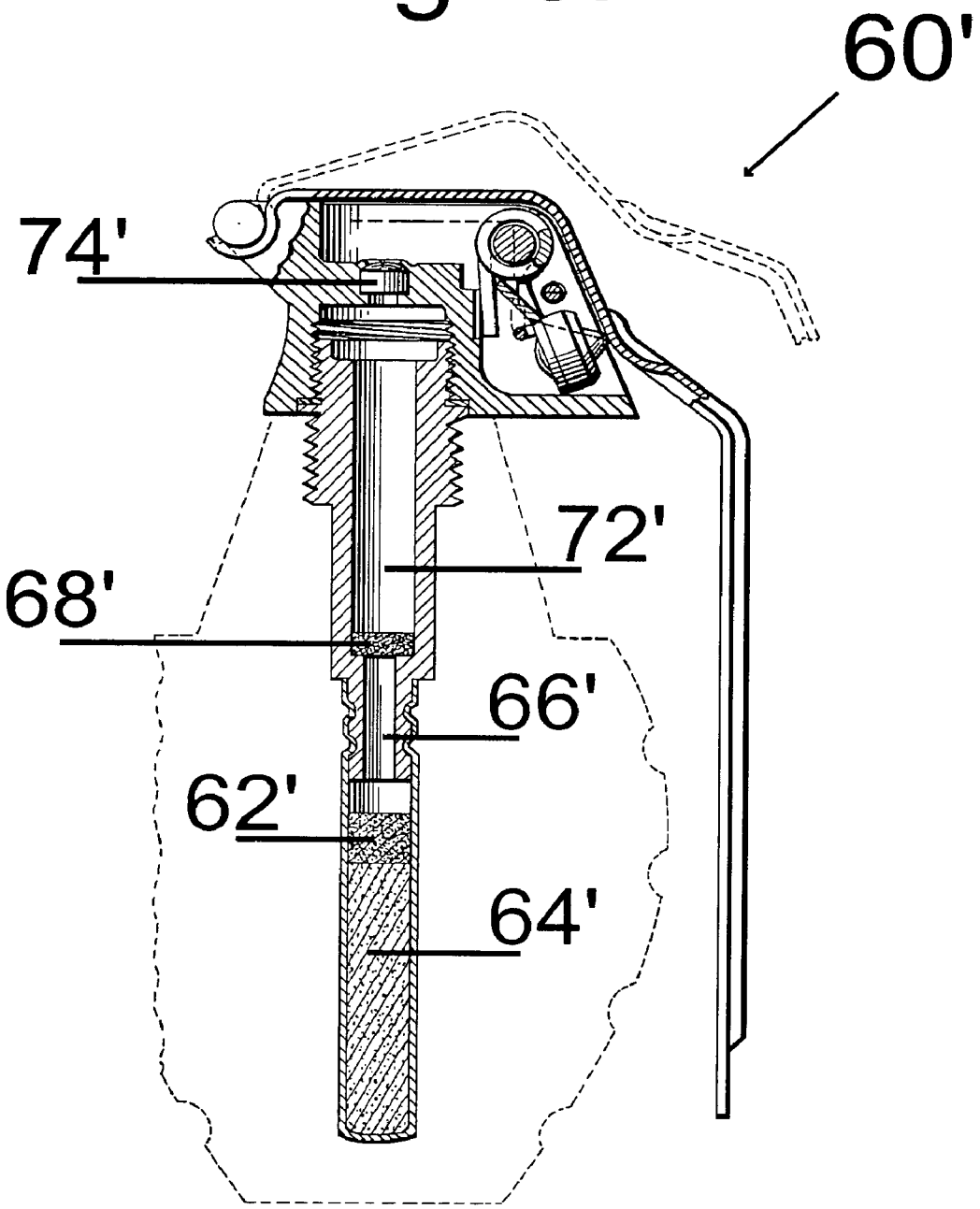
FIG. 5 shows in vertical half-section an instance of the invention pertaining to grenades like that in which the delay charge of the grenade according to the prior art has been deleted.

In FIG. 5, essentially the same structure is shown as to a grenade that depicts the second aspect of the invention, namely, grenade 60' incorporates all of the same elements as does the Lewis grenade 60 in using a triggering device to close off a hollow body containing the explosive except that, while the components of the Lewis grenade 60 are referred to with unprimed numbers, the elements of grenade 60' according to the invention are referred to using primed numbers 62', 64', etc. Also in FIG. 5, however, the delay charge 70 of the Lewis grenade is deleted whereby air gap 72' of FIG. 5 is seen to be much longer than is air gap 72 of the Lewis grenade shown in FIG. 4. As was pointed out in the '752 and '649 patents and already noted above, deletion of delay charge 70 would have the effect, ordinarily quite undesired, of bringing about essentially an instantaneous explosion of the grenade of FIG. 5 when percussion primer 74' is fired, thus producing the same result as shown and described with reference to grenade 30 of FIG. 3 and as intended in accordance with the invention—to kill the enemy rather than the friendly forces against whom the grenade was sought to be used.

The design and construction of other types of mines, in the form of other types of munitions such as mortars, shoulder-launched ground-to-air missiles, etc., could easily be carried out by a person of ordinary skill in the art, based on the present description of the manner of so doing, hence all such variations are deemed to fall within the spirit and scope of the invention and of the claims appended hereto. Also, other arrangements and disposition of the aforesaid or like components, the descriptions of which are intended to be illustrative only and not limiting, may also be made without departing from the spirit and scope of the invention, which must be identified and determined only from the following claims and the equivalents thereof.

I claim:

1. A cartridge mine, comprising:

an elongate firearms cartridge case;

an elongate hollow chamber extending longitudinally within said cartridge case;

a primer disposed at and closing off said hollow chamber near to a proximal end of said cartridge case, wherein said primer can be activated by a firing pin of a firearm into which said mine has been placed;

one or more projectiles disposed at and closing off said hollow chamber near to a distal end of said cartridge case; and a quantity of one or more energy-releasing materials adapted to be activated by activation of said primer so as to produce an energy release in an amount at least sufficient to render unuseable said firearm.

2. The cartridge mine of claim 1 wherein at least one of said energy-releasing materials comprises the explosive C4.

3. The cartridge mine of claim 1 wherein at least one of said energy-releasing materials comprises the explosive Cubane.

4. The cartridge mine of claim 1 wherein at least one of said energy-releasing materials comprises white phosphorus.

5. A grenade mine, comprising:

a hollow body closeable within a predetermined region thereof, containing a quantity of explosive, and formed of a material adapted to be broken into fragments thereof with sufficient force to have lethal effect upon explosion of said explosive material; and a triggering device adapted to be externally activated and to be inserted into said predetermined region of said hollow body and thereby to close said hollow body and to cause, upon being activated, said explosion of said explosive material within said hollow body, whereby said hollow body will become broken into fragments having lethal force;

wherein said explosion is caused to occur nearly immediately following said activation of said triggering device.

6. The grenade mine of claim 5 wherein said triggering device comprises:

an elongate tube having a distal end that is disposed firstly within said explosive material within said hollow body, and a proximal end by means of which said hollow body is closed.

7. The grenade mine of claim 6 wherein said elongate tube has disposed therein, in the following order commencing at said distal end:

a blasting cap;

a penetration charge;

an explosive device;

an explosive ignition charge;

an air gap; and a primer.

8. The grenade mine of claim 6 wherein said elongate tube has disposed therein, in the following order commencing at said distal end, a detonating charge;

a flash passageway;

a relay charge;

an elongate air gap; and a percussion primer.

* * * * *